US007753120B2

(12) United States Patent
Keller

(10) Patent No.: US 7,753,120 B2
(45) **Date of Patent: *Jul. 13, 2010**

(54) PORE FLUID SAMPLING SYSTEM WITH DIFFUSION BARRIER AND METHOD OF USE THEREOF

(76) Inventor: Carl Keller, 6 Easy St., Sante Fe, NM (US) 87504

( * ) Notice: Subject to any disclaimer, the term of this patent is extended or adjusted under 35 U.S.C. 154(b) by 124 days.

This patent is subject to a terminal disclaimer.

(21) Appl. No.: 12/001,801

(22) Filed: Dec. 13, 2007

(65) Prior Publication Data

US 2008/0142214 A1 Jun. 19, 2008

Related U.S. Application Data

(60) Provisional application No. 60/874,560, filed on Dec. 13, 2006.

(51) Int. Cl.
*E21B 49/08* (2006.01)
*E21B 23/00* (2006.01)
*E21B 43/10* (2006.01)

(52) U.S. Cl. ..... 166/264; 166/242.7; 166/207

(58) Field of Classification Search ..... 166/264, 166/242.2, 380, 207
See application file for complete search history.

(56) References Cited

U.S. PATENT DOCUMENTS 5,176,207 A 1/1993 Keller
5,377,754 A 1/1995 Keller
5,725,055 A * 3/1998 Schirmer et al. ..... 166/264
5,803,666 A 9/1998 Keller
5,853,049 A 12/1998 Keller
6,026,900 A 2/2000 Keller
6,109,828 A 8/2000 Keller
6,244,846 B1 6/2001 Keller
6,283,209 B1 9/2001 Keller
6,298,920 B1 10/2001 Keller
6,910,374 B2 6/2005 Keller
7,281,422 B2 10/2007 Keller
2004/0065438 A1 4/2004 Keller
2005/0172710 A1 8/2005 Keller
2007/0260439 A1 11/2007 Keller

* cited by examiner

*Primary Examiner*—Jennifer H Gay
*Assistant Examiner*—Cathleen R Hutchins
(74) *Attorney, Agent, or Firm*—Rod D. Baker

(57) ABSTRACT

A sampling system and method for use in pipes or in boreholes beneath the earth's surface, including the use of flexible borehole liners, the liners provided with a diffusion barrier to prevent contamination of fluid samples obtained by the system and method. There is provided a flexible diffusion barrier in the construction of a flexible fluid sampling liner, so as to nearly eliminate concern for diffusion transport into or out of the liner. The flexible diffusion barrier may be incorporated into and constructed with known devices, called spacers, in use with flexible borehole liners. The diffusion barrier according to the present disclosure is attached or secured by a suitable means to the interior surface, or the exterior surface, or both surfaces, of the flexible borehole liner. In one embodiment, a spacer with a diffusion barrier prevents both the diffusion into the liner, and the diffusion out of the liner, in the interval subtended by the spacer length.

34 Claims, 7 Drawing Sheets

PORE FLUID SAMPLING SYSTEM WITH DIFFUSION BARRIER AND METHOD OF USE THEREOF

CROSS-REFERENCE TO RELATED APPLICATIONS

This application claims the benefit of the filing of U.S. Provisional Patent Application Ser. No. 60/874,560, entitled Diffusion Barrier for Water Sampling System, filed on Dec. 13, 2006 and the entire specification thereof is incorporated herein by reference.

Also, this application is related to U.S. Provisional Patent Application Ser. No. 60/937,574, entitled Mapping of Contaminants in Geologic Formations, filed on Jun. 28, 2007, the contents of which also are incorporated herein by reference.

FIELD OF THE INVENTION (TECHNICAL FIELD)

The present invention relates to sampling systems for use in pipes and in boreholes beneath the earth's surface, and to flexible borehole liners, more particularly to pore fluid sampling and other similar uses for flexible borehole liners, and especially to the sealing capability of everting borehole liners.

BACKGROUND OF THE INVENTION

Flexible borehole liners are in commercial use for sealing subsurface boreholes and providing isolation for discrete spatial resolution of ground water sampling. U.S. Pat. Nos. 5,176,207 and 5,725,055, the teachings of which are incorporated herein by reference, are helpful examples of such subsurface borehole flexible liner apparatuses and methods. Useful background reference may also be had to U.S. Pat. No. 5,176,207, and U.S. Pat. No. 6,283,209 (the entire disclosures of which also are incorporated by reference herein) for further understanding of the use of flexible liners, placed by eversion, to accomplish down-hole pursuits. According to known practice, the interior pressure of the liner is maintained to be greater than the pore pressure in the medium adjacent to the borehole, thus forcing the liner fabric against the borehole wall to achieve a seal of the borehole against flow into and along the borehole hole, relative to the adjacent medium.

However, a concern remains with the function of the borehole liner as a sealing device over very long time periods. That concern is related to the molecular diffusion process, which is well known, to allow the relatively slow transport of contaminants, in solution, through thin barriers from a high concentration volume into an adjacent lower concentration volume. Such a diffusion process is central to the function of U.S. Pat. No. 5,804,743. In a like manner, tri-chloro-ethylene, and similar contaminants of ground water, can migrate via the diffusion process from the ground water external to a borehole, through the flexible liner material, and into the interior of the fluid filled liner which is intended to seal the borehole against contamination migration. In time, the diffusion process may also propagate the contaminant along the liner's axial length to other locations interior to the fluid-filled liner. Thereafter, further diffusion out of the liner interior into the surrounding medium may contaminate the pore fluids of the medium outside the liner, at a location remote from the point or points of diffusion into the liner. This particular diffusion transport path, i.e., (1) into the liner, (2) along the liner, and then (3) out of the liner, can deleteriously bypass the seal against contaminant transport otherwise expected to be provided by the pressurized liner.

The method and system of the present disclosure serve several functions. One is related to a prevention of the diffusion process described above. A second function, realized in actual use of certain embodiments, is to provide a lubricating surface on the liner exterior that reduces the friction associated with the eversion of the liner into position in a borehole. A third advantage is to prevent the contamination of the surrounding pore fluids by diffusion of contaminants entrained in some flexible liner materials during their manufacture. Prevention of diffusion from the liner itself allows the use of liner materials which would otherwise conflict with the pore fluid sample integrity (as representative of the ambient pore fluid).

SUMMARY OF THE INVENTION (DISCLOSURE OF THE INVENTION)

The presently disclosed method and apparatus provide a very flexible diffusion barrier in the construction of a pore fluid sampling liner, so as to nearly eliminate concern for diffusion transport into or out of the liner. The flexible diffusion barrier may be incorporated into and constructed with known devices, called spacers, in use with flexible borehole liners. The usual spacer function is to prevent the seal of a short, discrete, portion of the borehole by the liner. The unsealed portion may be a defined orifice in or on one side of the liner, or may define an annular portion about the circumference of the liner, and corresponding to the defined interval length (i.e., as measured longitudinally of the borehole and liner). The unsealed interval defines an interval (often, but not necessarily, approximately vertical) of the borehole from which a sample of pore fluid is drawn in the sampling procedure. "Pore fluid" or "sample fluid" is the ambient fluid, such as naturally occurring or artificially contaminated groundwater, situated in the media (e.g., subsurface geologic formation) adjacent the borehole.

Known or yet-to-be-developed spacers, therefore, typically serve to maintain a pre-determined portion of the flexible liner in a spaced-apart relation to the borehole wall; there accordingly may be an interstitial volume between the liner and the borehole wall, into which pore fluid may flow from the adjacent medium. The spacer is flexible and attached to the liner in any manner which permits it to be everted with the liner as it is emplaced in the borehole.

The diffusion barrier according to the present disclosure is attached or secured by a suitable means to a surface of the flexible borehole liner. The diffusion barrier in a preferred embodiment is mated to the inner surface of the spacer, which in turn lies against the outer surface of the liner. In such an embodiment, the axial extent of the diffusion barrier may correspond generally with the axial length of the spacer itself. A spacer with a diffusion barrier prevents both the diffusion into the liner and the diffusion out of the liner in the interval subtended by the spacer length.

In alternative embodiments, the diffusion barrier may be provided along the entire length of the flexible liner; in such embodiments, the diffusion barrier effectively is a coating or layer disposed upon the entire liner surface at the time of liner manufacture. In added alternatives of the apparatus according to this disclosure, the diffusion barrier may be disposed upon either the interior or the exterior surface of the liner, or potentially even both such surfaces.

Providing a flexible borehole liner with a diffusion barrier prevents most or all of the diffusion of concern, which otherwise may cause cross-contamination of the pore fluid samples obtained by currently used borehole liner systems. The diffusion barrier reduces the risk of undesirable cross-contamination via the liner interior. Furthermore, the diffusion barrier prevents other potentially significant diffusion effects, even when transport along the interior of the liner is not significant. An important additional advantage of one version of the apparatus as tested is a reduction in the normal friction of the liner and spacer components at the point of eversion of the liner. The reduction in friction permits liner installation by eversion with a comparatively lower driving pressure than normally required with current liners.

BRIEF DESCRIPTION OF THE DRAWINGS

The attached drawings, which form part of this provisional patent application, are as follows.

DETAILED DESCRIPTION OF THE INVENTION (INCLUDING BEST MODE FOR PRACTICING THE INVENTION)

U.S. Pat. No. 6,910,374, incorporated herein by reference, describes the installation of a flexible liner by eversion for the purpose of measuring flow paths from a borehole, pipeline, duct or conduit. It is contemplated that the invention will find frequent application in the field of ground water sampling in boreholes defined in geologic formations beneath the surface of the Earth. However, the invention may find alternative utility in specialized circumstances in a conduit or duct, such as a pipeline, where it is desired to sample conditions at locations along the line. Accordingly, in this disclosure the term "borehole" may include artificial pipes and conduits.

Figure 1:
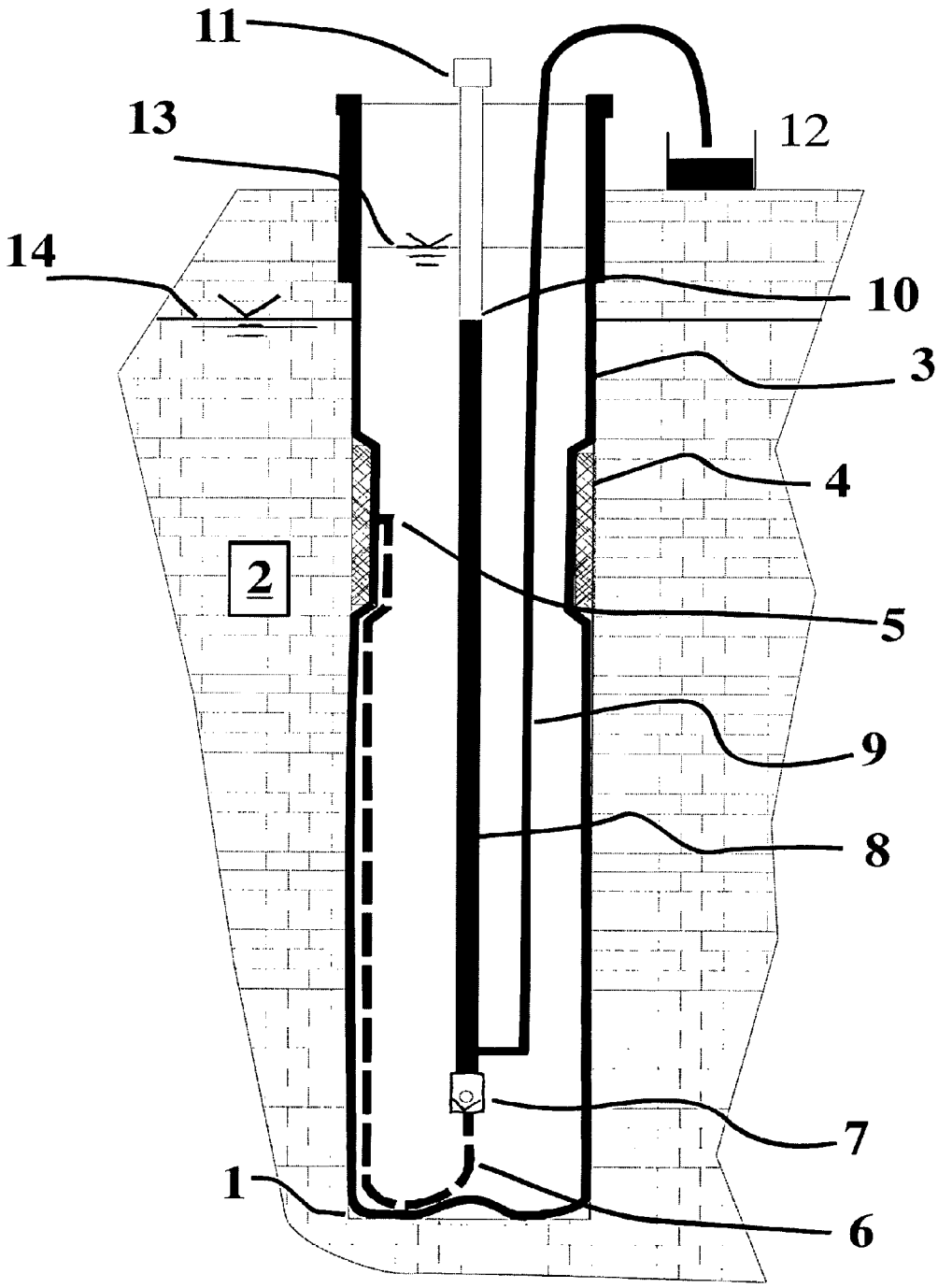
FIG. 1 is an elevation view of a fluid sampling liner system according generally to known convention, shown diagrammatically in longitudinal cross section with a single sampling port (for clarity of illustration)

Flexible borehole liners such as that shown generally by FIG. 1 have been developed according to the present disclosure for the purpose of extracting ground water samples at specified, pre-determined locations down a borehole 1. In this disclosure, a flexible borehole liner 3 is installed by eversion down a borehole 1 generally in accordance with the teachings of U.S. Pat. No. 6,910,374. Succinctly describing the basic method, gas displacement of the water (or other fluid) in the large diameter tube 8 permits a sample of ambient fluid in the pores of the subsurface formation or media 2 to be extracted, via tube 9, from the interstitial volume of a spacer 4 situated proximate to the medium or media 2 of interest. The extracted sample may then be tested for characteristics and constituents of particular interest. An advantageous feature of such a sampling system is the reliability of the extracted sample as being representative of the condition of the ground water in the geologic formation in which the borehole 1 was formed.

FIG. 1 shows the borehole 1 in a geologic medium 2 is lined with the liner 3. The liner 3 is filled with water, or other fluid, to a level 13 greater than the fluid level (e.g., natural water table) in the surrounding formation 14 to provide an interior liner pressure greater than the pressure in the formation. The pressure difference urges the liner 3 against the borehole wall to affect a good seal of the borehole 1, preventing migration of contaminated ground water from the formation 14 into and within the borehole volume. For the sake of simplicity of illustration, FIG. 1 shows only a single sampling interval at a single location. It is understood by one of ordinary skill in the art that there frequently may be any number of a plurality of sampling intervals, at different locations at differing elevations within the borehole 1.

A preferred embodiment of the sampling system is shown to include a spacer 4, which defines an interval of the borehole 1 not sealed by the liner 3. Additional details of the spacer 4 are described hereafter. The water in the interstitial volume of the spacer 4 is conducted through the sealing liner 3 via the port 5, and thereafter conducted through the sampling tube 6, through the check valve 7, and into the larger diameter standing tube 8. The sample fluid rises in the standing tube 8, potentially filling the larger-diameter standing tube 8 to a water level 10, at approximately the same elevation as the level 14 in the formation 2. The sample fluid (e.g. sampled ground water) also rises to the same equilibrium level in the smaller diameter sampling tube 9. Application of gas pressure (by any suitable means, such as an air compressor and fitting 11) to the top of the standing tube 8, forces the sample fluid downward in tube 8, thus closing the check valve 7. With the check valve 7 closed, the sample fluid is therefore forced to flow up the sampling tube 9 to a container on the surface 12. This simple gas displacement pumping system is well-suited to draw sample water from the formation 2 at the location of the spacer 4, bringing the sample water to the surface facility 12 for testing and analysis.

As explained further herein, to preserve the integrity of an extracted sample, it is important that the pore water in the geologic formation 2 at one sample space interval, and its associated sampling port, is not in fluid communication with the ground water being sampled at a different location and port, via the borehole.

Figure 2:
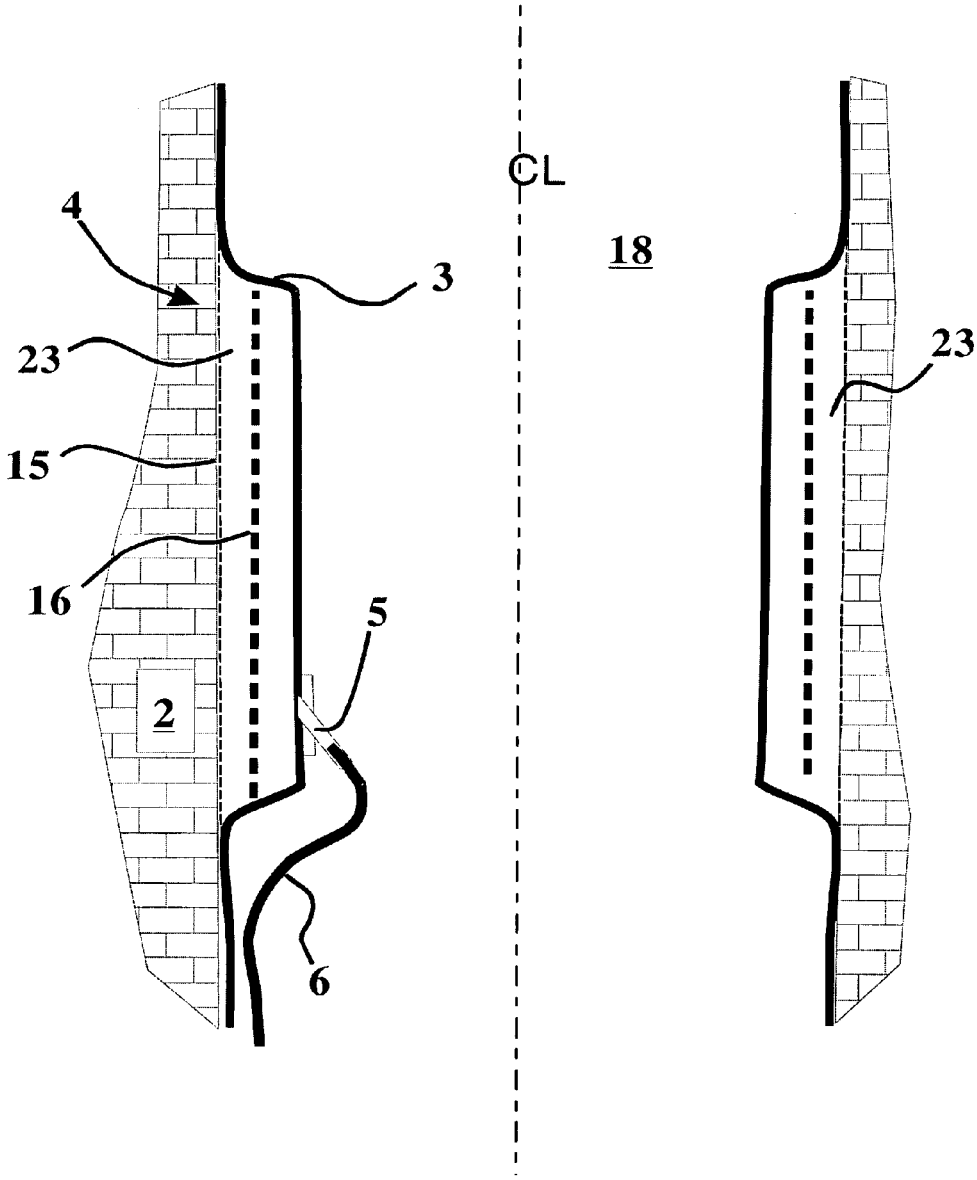
FIG. 2 is an enlarged view of a portion of the diagram of FIG. 1, providing a more detailed depiction of a spacer component, and without the use of a diffusion barrier.
Figure 3:
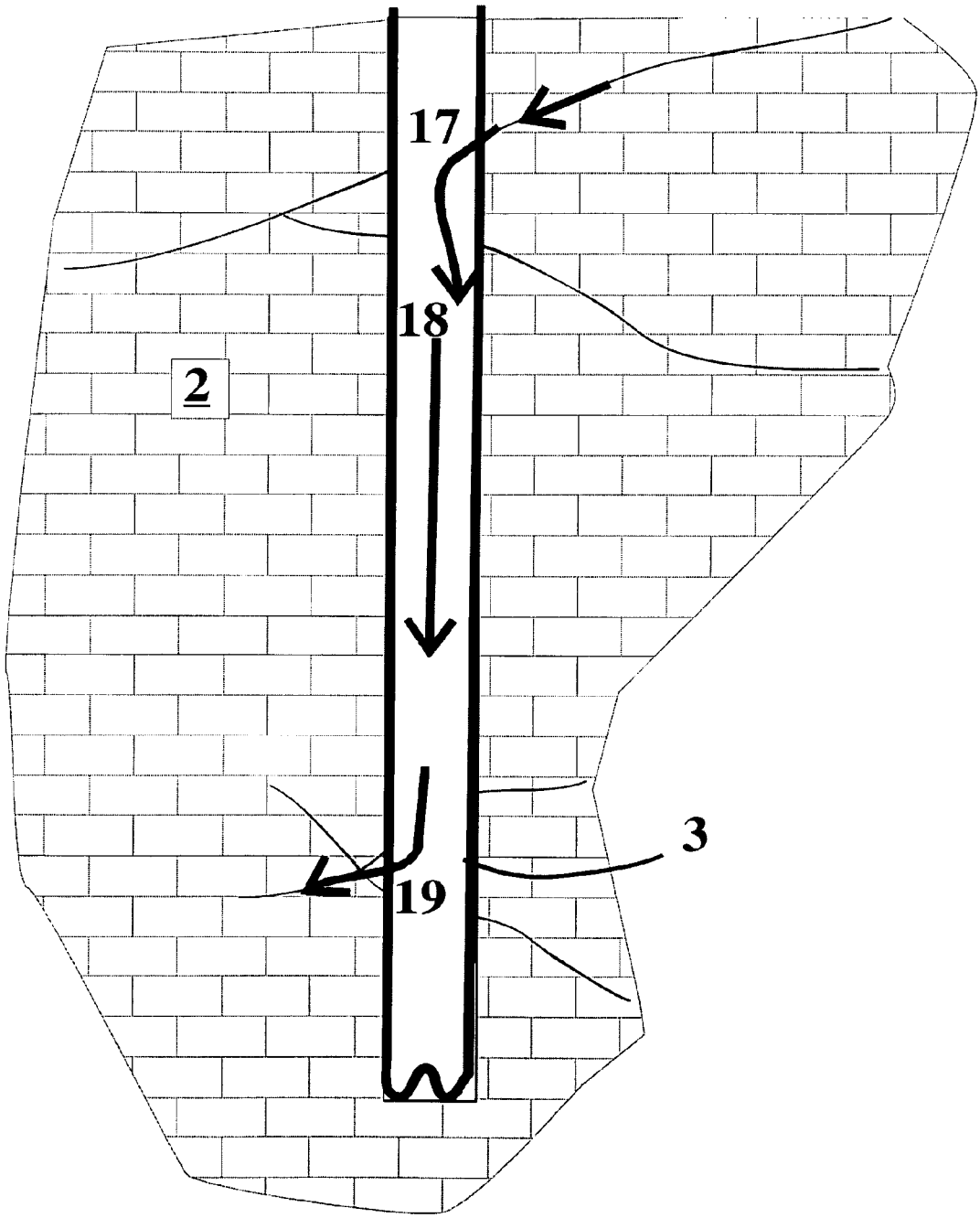
FIG. 3 is a diagrammatic longitudinal cross section of a borehole, with a flexible liner installed therein, showing with directional arrows a possible diffusion path of concern between nearby, but vertically separated, spacers.
Figure 4:
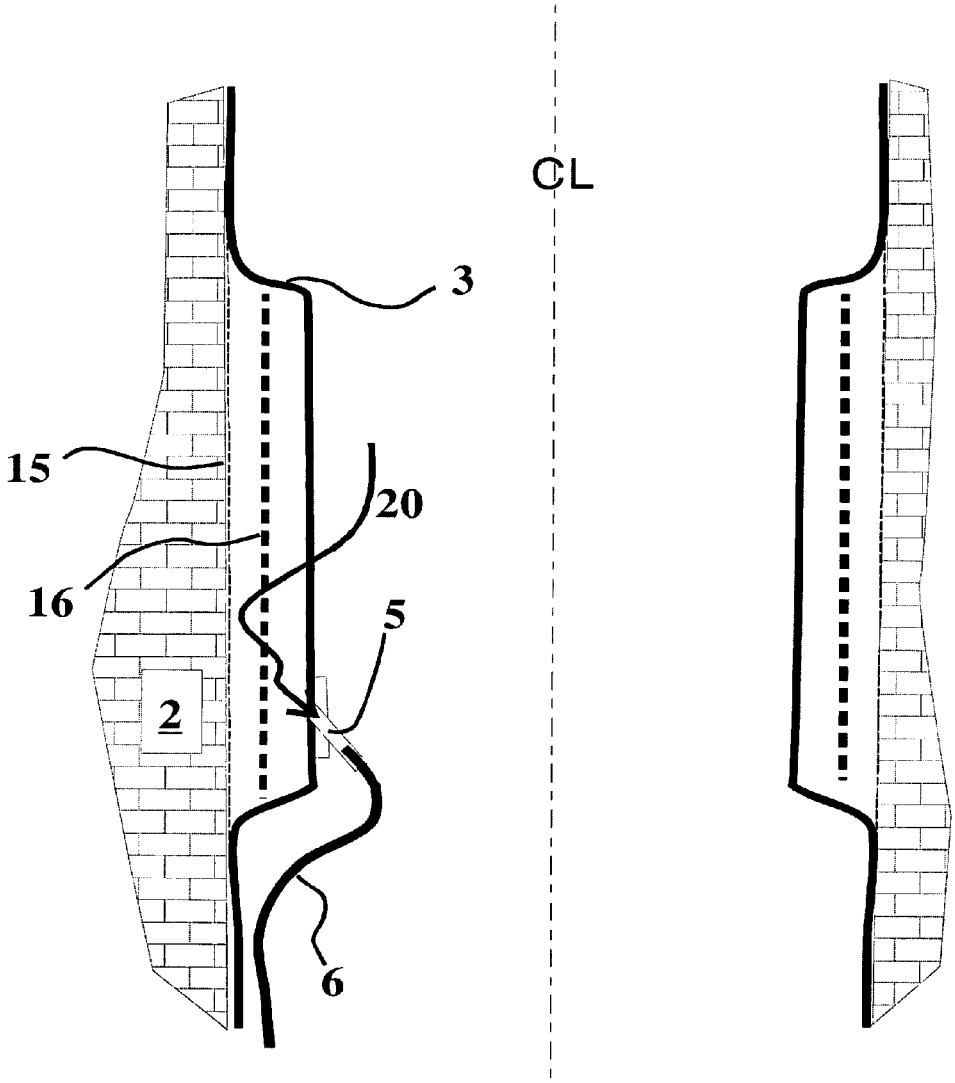
FIG. 4 is an enlarged side cross-sectional view of a portion of a fluid sampling liner system in the vicinity of its spacer component, showing with a directional arrow another possible diffusion path of concern, from the fluid within the liner interior, through the liner into the spacer interstitial volume outside the liner, and into the sampling port.

FIG. 2 depicts a spacer 4 used to prevent the liner from sealing a short length or interval of the borehole 1 at a preselected sampling location; the liner is designed and placed to provide of a sampling port 5 at the sampling location. Whereas there are numerous spacer designs known in the art, conventional spacers often include an outer filter layer, an interior coarse mesh open to water or gas flow, and a port through the liner 3. The port 5 is used to extract a sample of the pore water interior to the spacer and derived from the pore space of the formation. Due to the short travel distance from the interior of the liner 3, through the liner, and into the interstitial volume 23 of the spacer coarse mesh, diffusion of contamination into the liner (or from the interior of the liner), potentially can violate the integrity of the water sample in or near the spacer as representative of formation water. FIG. 3 shows a diffusion path of concern between different elevations in the borehole 1. Also, FIG. 4 shows how contamination can migrate through the liner 3, into the interstitial volume 23 of the spacer 4, and then into the sample port 5 when a sample is being drawn for analysis.

Continuing reference to FIG. 2 shows the details of a spacer 4. The spacer 4 has an outer layer 15 and an inner permeable layer 16 or mesh suitably attached to the exterior of the liner 3 at the top and bottom of the spacer 4. As suggested by FIG. 2, the spacer 4 typically is generally a cylindrical annulus to provide a permeable surround on the exterior of the liner 3. The spacer 4 maintains the liner 3 in a spaced-apart relation from the borehole wall, to provide the interstitial volume 23. The presence of the spacer 4 thus allows pore water to be drawn from the formation 2 and into the inside surface of the borehole 1, where it contacts the spacer 4. The sampled water is conducted through the permeable layer 16 to the port 5 and into the transfer tube 6 to the pumping system including the check valve 7, standing tube 8, sampling tube 9, pump and fitting 11, and analysis collector 12.

The foregoing described spacer 4 and pumping system (elements 6 to 12) is reproduced for any number of different spacers 4, at different elevations on the same sealing liner 3 in a single borehole 1. The several pumping systems are gathered into a tubing bundle in the interior of the hole, possibly within the interior space of the liner itself.

A premier advantage of the disclosed system and method is that the pore water in the geologic formation 2 at any given sample interval/port (4/5) is not in fluid communication, via the borehole 1, with the ground water being sampled at any other different port at a higher or lower elevation in the borehole. Notably, the pressurized liner 3 provides the seal of the borehole 1 between the multiple sampling locations in the same hole.

However, the fluid-filled interior of the liner 3 can provide a pathway for contamination at one sampling elevation in the borehole 1 to propagate by diffusion to another sampling elevation in the same borehole. One potential contamination pathway is shown generally in FIG. 3. The pathway is provided by the slow diffusion of contamination from the ground water at one elevation (e.g., location 17), through the liner 3, into the fluid fill of the liner, then along the fluid-filled interior volume 18 of the liner, and out through the liner 3 into the formation 2 at a second elevation (e.g., 19 in FIG. 3). While this diffusion process is very slow, in some situations of very high contamination at a spacer elevation, a significant amount of contamination by means of diffusion can occur at an adjacent location which may otherwise not produce any contaminated water.

A greater threat to the pore sample fluid (e.g., ground water) integrity is the diffusion of contamination from the fluid fill within the interior volume 18 of the liner 3 into the interstitial volume 23 associated with a spacer 4. FIG. 4 shows this short diffusion path (depicted by directional arrow 20) from the liner into the interstitial volume 23. Due to the very short diffusion distance from the interior volume of the liner 3, through the liner, into the interstitial volume of the spacer coarse mesh 16, and into the port 5; the diffusion of contamination from the interior volume (18 in FIG. 3) of the liner can violate the integrity of the sample fluid as being representative of formation water. Thus an object of this invention is to provide a diffusion barrier which will prevent such a fluid connection or communication of one sampling interval to another sampling interval via diffusion along the interior of the liner 3.

One possible simple solution to prevent cross-contamination between sampling locations in a down-hole liner may be to fill the liner with a lean cement or perhaps with a bentonite slurry. However, those fill materials may prevent or complicate the installation or removal of the liner. Again, the process and system of the present disclosure provide a diffusion barrier mode and means for preventing contaminating communication of one sampling interval with another sampling interval via diffusion. Installation and removal of the inventive system, in contrast to a slurry, are relatively simple by the expedient of everting and inverting the liner (as taught by U.S. Pat. No. 6,910,374 and others).

The present invention provides a barrier that is thin, flexible, and resistant to diffusion of typical ground water contaminants. Examples of such barrier materials are thin films made of Mylar, Teflon, or PVDF polymers. These thin films may be coated with a thin metal deposit to further reduce their diffusion coefficients for many ground water contaminants. The advantage of the thin films is that they do not change significantly the ability to evert the flexible liner into the borehole. Also, since some flexible liners, like that of FIG. 1, may be simply lowered into the borehole and then inflated with an appropriate liquid or gas (e.g., water or air), the thin diffusion barriers do not add significant bulk to the assembly to impede its being lowered into an open borehole.

Figure 5:
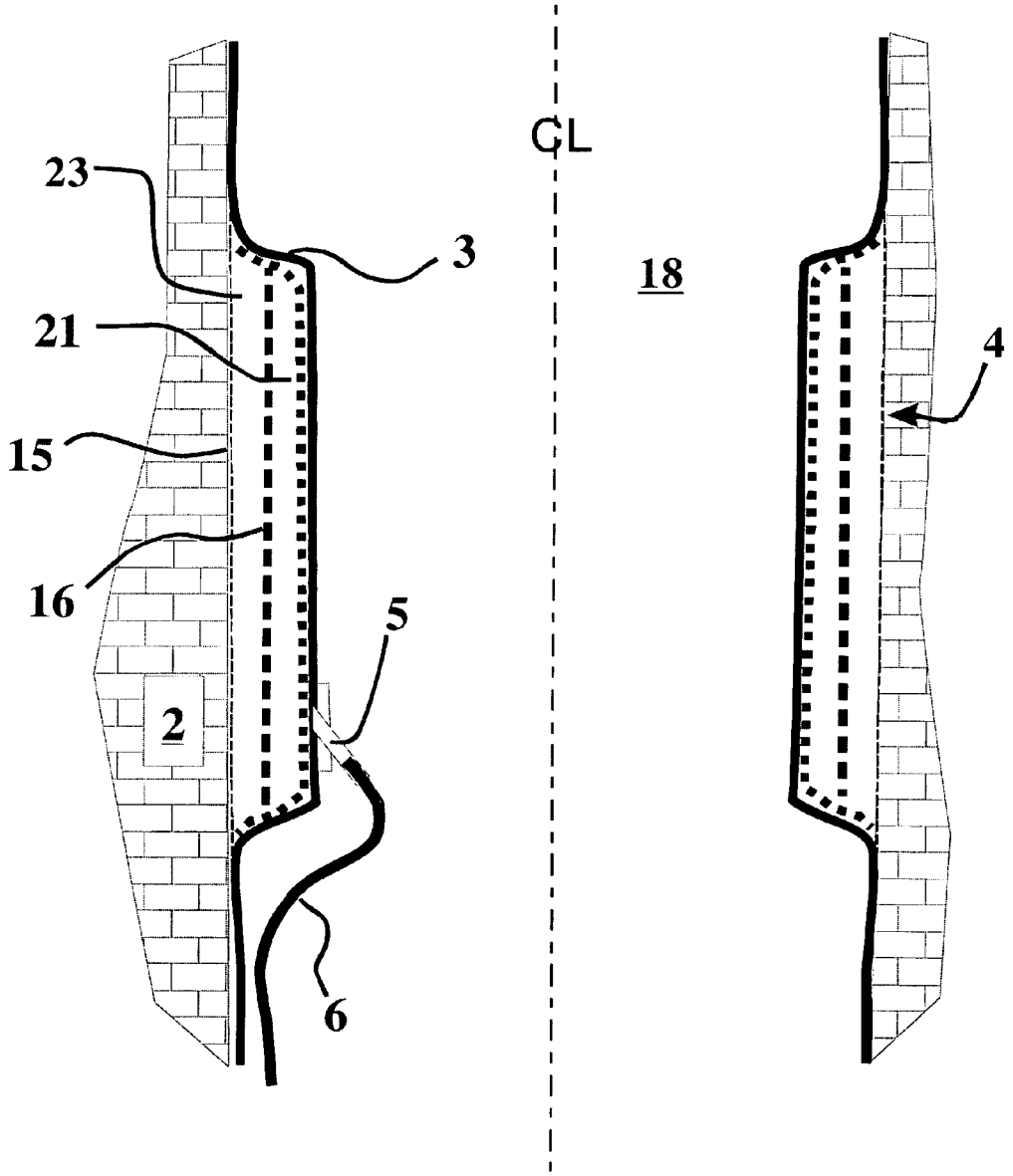
FIG. 5 is an enlarged elevation view, in longitudinal cross section, of an apparatus according to the present disclosure and showing the provision of a diffusion barrier on the exterior of the liner and along the axial interval corresponding to the spacer.

FIG. 5 shows the configuration of the spacer 4 with a diffusion barrier 21 according to one embodiment of the present disclosure. The diffusion barrier 21 prevents the diffusion of contaminants both into and out of the liner 3. This barrier 21 improves the ability of a normal flexible liner sampling system to produce ground water, or a pore gas sample, more representative of the in situ nature of those fluids, without concern about the diffusion rate in the interior volume of the liner 3. The barrier 21 contains a passage for the sample fluid to flow from the permeable layer or mesh 16 into the sample port 5, to the transfer tubing 6 of the liner system.

According to the disclosed system, the diffusion barrier 21 is a thin, flexible, layer of material that is very resistant to diffusion of typical ground water contaminants. Examples of such barrier layer materials are thin films or layers of Mylar, Teflon, or PVDF polymers. Further, these thin polymer layers may be coated with a thin metal deposit (e.g., by mass vapor deposition, or other suitable application modes known in the art) known to reduce diffusion coefficients for many ground water contaminants. The advantage of the thin films constituting the diffusion barriers is that they do not affect significantly the ability for the flexible liner to evert down the borehole. Also, since some flexible liners, such as that of FIG. 1, may be simply lowered into the borehole 1 and then inflated with an appropriate fluid or gas (e.g., water or air), thin, flexible diffusion barriers do not add significant bulk to the assembly to impede its being lowered into an open borehole 1.

In many installations in fractured rock boreholes, the only portion of the liner 1 with a large surface area exposed to the diffusion of contaminants is that portion of the liner covered by a spacer 4. In such case, the diffusion barrier 21 may not be necessary over the entire liner surface. However, the covering of the entire outer surface of the liner 3 with a diffusion barrier 21 is an optional configuration.

The addition of this diffusion barrier to current flexible liner designs addresses the main concern of potential diffusion transport of contaminants by way of the interior of the liner from one sampling elevation to another. Another attractive feature of some of the candidate diffusion barriers 21 is that they may be heat-welded to the base of the port 5 (FIG. 5) to provide a good seal between the diffusion barrier 21 and the interior of the port 5. The preferred tubing used with the present diffusion barrier system design is PVDF tubing; PVDF polymer is an excellent diffusion barrier against the transport of contamination from the fluid within the liner to the interior of the tubing. Tubes 6, 8, and 9 accordingly are fabricated from PVDF polymer.

An additional potential benefit of the diffusion barrier material, with or without a thin metal film, is that it may reduce the friction of the everting liner on itself, and thereby reduce the minimum pressure required to evert the liner material in a passage such as a pipe or borehole. Thus, it is preferable to select a polymer or polymer composite material for the diffusion barrier layer which has a low coefficient of friction; the resulting "lubricating" property of the diffusion barrier promotes a slick and smooth eversion or retrieval of the liner into and out of the borehole.

Diffusion tests have shown that the candidate diffusion barrier material tested reduces the diffusion rate through the liner to less than 1% of the rate without the barrier. This implies that the diffusion rate into, and then out of, the liner through two barriers would be ~0.01% of that without the barrier.

The materials used to fabricate the liner 3 sometimes contain toluene which may leach into water in contact with the liner, which is then detected in the water sample chemical analysis. The diffusion barrier 21 on the exterior of the liner 3 can prevent such extraneous chemical compounds from being leached out of the material of the liner layer and into the water adjacent to the liner.

In some situations, the borehole 1 and liner 3 are located in very porous geologic media where significant contaminant diffusion into the liner can occur anywhere along the borehole. In such a situation, the diffusion barrier material is best used as a complete external covering of the liner, i.e., the entire exterior surface of the liner is covered by a continuous diffusion barrier. In an alternative embodiment providing the same function, the diffusion barrier material can be an inside layer bonded to the interior surface of the liner, to prevent the diffusion into, or out of, the interior of the liner. However, an interior diffusion barrier does not provide the advantage of prevention of chemical leaching from the liner material into the sample water.

Referring to all the drawing figures collectively, there thus is provided according to this disclosure a liner system for use in performing fluid sampling at one or more sampling locations in a borehole 1 into a formation 2 in the Earth's subsurface. As described above, the system features a flexible tubular liner 3 extendible within the borehole and inflatable to a diameter effective to urge the liner against a wall of the borehole, so that when it is inflated the liner 3 defines an interior volume 18 (FIG. 3). At least one spacer 4 is disposed on the liner 3 so that when the liner is extended and inflated within the borehole 1, the spacer 4 provides an interstitial volume 23 between the liner 3 and the borehole wall a sampling location; a flexible diffusion barrier 21 is placed, situated or secured on the tubular liner 1, with the barrier substantially preventing contamination migration, via diffusion, through the liner to or from the interior volume 18.

Figure 6:
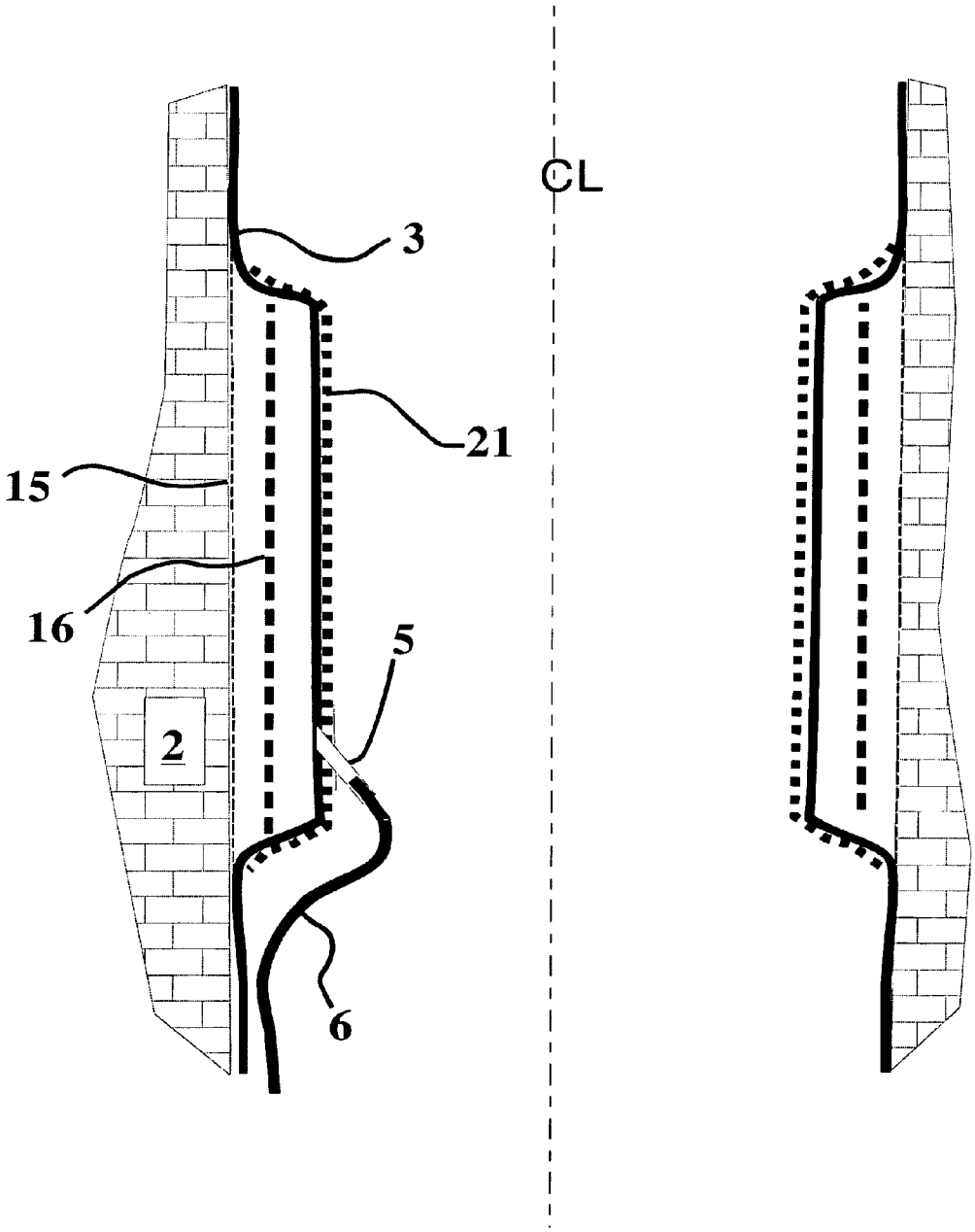
FIG. 6 is a view similar to FIG. 5, depicting an alternative embodiment of the apparatus with the diffusion barrier provided on the interior of the liner.

In the preferred embodiment of the system, the diffusion barrier 21 is disposed on an exterior surface of the tubular liner 3 when the liner is extended within the borehole 1. Alternatively, the diffusion barrier 21 may be disposed on an interior surface of the tubular liner 3 when the liner is extended within the borehole. This alternative embodiment is indicated in FIG. 6. The diffusion barrier 21 may substantially cover the entire exterior surface of the liner 3 or, alternatively, it may be provided in a plurality of segments, with segments covering interval portions only of the liner, adjacent to each of the spacers 4.

As suggested by FIGS. 4 and 5, the diffusion barrier 21 may be secured directly to a corresponding one of each of the at least one spacers 4. The diffusion barrier 21 can substantially cover the entire interior surface of the liner, or cover interval portions only of the liner 3, adjacent to each corresponding spacer. In a preferred embodiment, the flexible diffusion barrier 21 is fashioned from a material selected from a group consisting of Mylar® material, Teflon® material, and PVDF polymer material. Further, the diffusion barrier 21 preferably but optionally also comprises a thin metal film deposited on the barrier substrate material.

To permit sampling, the system has a sampling port 5 defined through the liner 3 in the interval of each spacer 4, by which sample fluid collected in the associated interstitial volume 23 may pass through the liner 3. There is a sampling tube 9 in fluid communication with the port 5, through which a sample fluid may be transported for analysis. There is provided a means for pumping the sample fluid through the sampling tube 9; the pumping means includes: a standing tube 8, in fluid communication with the sampling tube 9 as seen in FIG. 1, and in which the sampling fluid may rise; means such as a pump and fitting 11, for applying pressure to sampling fluid within the standing tube 8 (thereby to move sampling water through the sampling tube); and a valve, preferably a check valve, in connection with the standing tube 8 to prevent backflow of sample fluid from the standing tube toward the interstitial volume 23 (e.g., via the transfer tube 6, also as depicted in FIG. 1).

From the forgoing, the method of this disclosure is evident. Nevertheless, the method can be described as a method for performing ground water sampling at at least one sampling location in a borehole 1 into a formation 2 in the earth's subsurface, and the basic method features the process of: (1) extending a flexible tubular liner 3 within the borehole; (2) inflating the liner 3 to urge the liner against a wall of the borehole 1 and to define an interior volume 18 within the inflated liner; (3) disposing at least one spacer 4 on the liner 3 to provide, when the liner is extended and inflated within the borehole 1, an interstitial volume 23 between the liner and the borehole wall at the at least one sampling location along the borehole length; (4) providing a diffusion barrier 21, comprising a layer of flexible material, on the tubular liner 3; and (5) substantially preventing, with the diffusion barrier 21, all or substantially all contamination migration via diffusion through the liner 3 to or from the liner's interior volume 18.

The method preferably also has the further step of disposing the diffusion barrier 21 on an exterior surface of the tubular liner (as suggested in FIG. 5) or alternatively disposing the diffusion barrier on an interior surface of the tubular liner 3 (as suggested in FIG. 6). The step of disposing the diffusion barrier may be covering with the diffusion barrier substantially the entire exterior surface of the liner 3. Alternatively, disposing the diffusion barrier 21 may be the covering, with the diffusion barrier, only interval portions or segments only of the liner adjacent to each of the spacers 4. Preferably, the method includes securing the diffusion barrier 21 directly to each of the spacers 4.

In an alternative mode of the method, there is a step of covering with the diffusion barrier 21 substantially the entire interior surface of the liner 3. Again, "covering with the diffusion barrier" may mean covering only interval portions or segments of the liner 3 at intervals adjacent to each of one or more spacers 4.

Providing a flexible diffusion barrier 21 may comprise selecting the layer of barrier substrate material from a group consisting of Mylar® material, Teflon® material, and PVDF polymer material. Or, "providing a flexible diffusion barrier" may include the step of selecting the layer of barrier material from the group of polymer composites. In either case, there is the preferred further step of depositing a thin metal film on the layer of barrier material.

To accomplish sampling according to the process, the method further includes the steps of: (1) defining a sampling port 5 through the liner 3 in the interval of the spacer 4; (2) allowing sample fluid to collect in the interstitial volume 23; passing sample fluid through the liner 3 via the sampling port 5 and to a sampling tube 9; and transporting sample fluid through the sampling tube 9 for analysis. In a further step of pumping the sample fluid through the sampling tube 9, the pumping step includes allowing sample fluid to rise in a standing tube 8 in fluid communication with the sampling tube 9, applying pressure to sample fluid within the standing tube 8 to move sample fluid through the sampling tube 9, and preventing backflow of sample fluid from the standing tube 8 toward the interstitial volume 23.

A sampling tube 9 made of PVDF polymer material preferably is provided, and a standing tube 8 made of PVDF polymer material also is preferable. The relative impermeability of PVDF polymer substantially prevents cross-contamination to or from the sample fluid. But in various versions of the process, there is an advantageous step of preventing, with the diffusion barrier, contaminant migration from the liner interior volume 18 into the sample fluid. Also, the users of the process may take the step of minimizing or preventing, with the diffusion barrier, any significant migration of contaminants within the layer of flexible material of the barrier 21 into the interstitial volume 23.

Advantageously, the method may include a step of selecting for the barrier material a layer of flexible material with a low surface coefficient of friction, thereby manifesting a lubricating property, and thus promoting extension and inflation of the liner 3 in the borehole 1

Another application of the flexible diffusion barrier is to form an inflatable balloon of the diffusion barrier material inside the liner to prevent longitudinal migration of contaminants inside the liner. This diffusion barrier balloon design is useful as a remedy of earlier liner designs which do not have the external barrier to diffusion. A series of deflated balloons of the barrier material can be spaced on an inflating tube and lowered into the interior of the liner and inflated to discourage longitudinal diffusion in the interior of a liner.

Yet another embodiment is to use a diffusion barrier as an external cover on a second liner that is everted into the interior of a liner already in position in the borehole. The interior concentric liner would prevent, or reduce, diffusion along the interior of the first liner without the need to remove the first liner.

Figure 7:
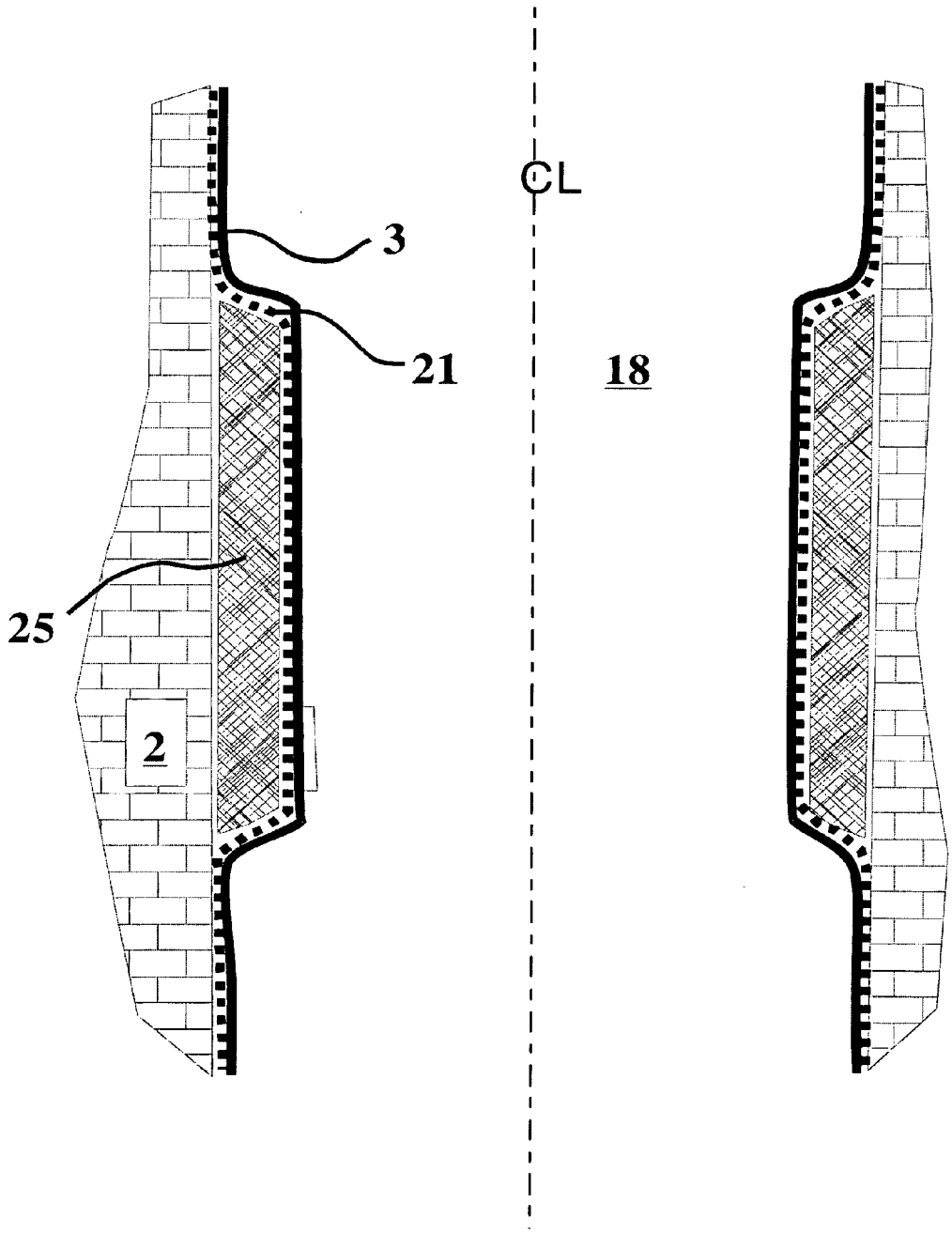
FIG. 7 is a sectional side view similar in certain respects to FIG. 2, but showing the use of absorbent material strips on the liner, in lieu of sampling tubes and pumps, to serve as a means for sampling.

Attention is invited to FIG. 7, illustrating the use of the diffusion barrier element in an alternative embodiment of the inventive system and method. Another application of the present disclosure is to have the spacer on the exterior of the liner 3 include an absorbent material. The absorbent material (e.g., 25 in FIG. 7) permits sample material to be held in place at the sampling location, pending retrieval of the liner 3 from within the borehole 1. The diffusion barrier 21 situated between the liner 3 and the absorbent material 25 provides the same protection of cross-contamination of fluids absorbed into the material 25 from the formation 2, with the fluid within the liner interior 18.

The absorbent material 25 can be composed of any of several suitable materials, such as a felt of cotton, polypropylene fibers, activated carbon cloth, or granular carbon in a supporting gel such as edible gelatin. The primary requirement of the absorbent material 25 is that it is capable of absorbing by diffusion or similar processes the contaminant (s) of interest in the formation 2 at the selected location.

Referring still to FIG. 7, the absorbent material 25 may be provided in a long flattened oblate form and attached to the outside of the liner 3 by a suitable means such as heat welding, buttons, or hook and loop attachments. The thin form is necessary to allow a good seal to be obtained between the liner and the hole wall to prevent contaminant transport in the interstitial space of the liner, absorbent material, and the borehole wall.

After initial manufacture, the liner 3 is then inverted, in one form of emplacement, such that the liner can then be everted into the borehole 1. A vent tube may be needed to allow the water to flow from the borehole as the liner is everted into the borehole. As the liner everts, the absorbent material 25 is pressed against the borehole wall (which may be composed of granular sediments or porous and fractured rock). Once in place with the absorbent material 25 pressed firmly against the borehole wall by the liner 3, any contaminants resident in the pore or fracture water of the formation 2 can migrate into the absorbent material. The contaminant distribution in the bore hole wall is allowed to equilibrate with the contaminant distribution in the absorbent material 25. In this manner, the distribution of contaminants in the pore space of the hole wall becomes directly related to the contaminant distribution in the absorbent layer 25.

After a suitable time, the liner 3 is inverted from the borehole, carrying with it the spacer/absorber to the surface. The inverting 3 liner prevents any further contact with the borehole wall. The absorbers 25 are thus recovered by inversion of the liner to allow analysis of the absorbed fluids or contaminants absorbed directly from the formation into the absorber.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

I claim:

1. A liner system for use in performing ground water sampling at at least one sampling location in a borehole into a formation in the earth's subsurface, comprising:

a flexible tubular liner extendible within said borehole and inflatable to a diameter effective to urge said liner against a wall of said borehole, wherein when inflated said liner defines an interior volume;

at least one spacer disposed on said liner, wherein when said liner is extended and inflated within said borehole, said spacer provides an interstitial volume between said liner and said borehole wall at said at least one sampling location; and a flexible diffusion barrier affixed directly on said tubular liner, said barrier substantially preventing contamination migration via diffusion through the liner to or from said interior volume.

2. A system according to claim 1 wherein said diffusion barrier is disposed on an exterior surface of said tubular liner when said liner is extended within said borehole.

3. A system according to claim 1 wherein said diffusion barrier is disposed on an interior surface of said tubular liner when said liner is extended within said borehole.

4. A system according to claim 2 wherein said diffusion barrier substantially covers the entire exterior surface of said liner.

5. A system according to claim 2 wherein said diffusion barrier covers interval portions only of said liner adjacent to each of said at least one spacer.

6. A system according to claim 5 wherein said diffusion barrier is secured directly to each of said at least one spacers.

7. A system according to claim 3 wherein said diffusion barrier substantially covers the entire interior surface of said liner.

8. A system according to claim 3 wherein said diffusion barrier covers interval portions only of said liner adjacent to each of said at least one spacer.

9. A system according to claim 8 wherein said diffusion barrier is secured directly to each of said at least one spacers.

10. A system according to claim 1 wherein said flexible diffusion barrier comprises a material selected from the group consisting of Mylar material, Teflon material, and polyvinylidene fluoride polymer material.

11. A system according to claim 10 wherein said diffusion barrier further comprises a thin metal film deposited on said barrier material.

12. A system according to claim 1 further comprising:

a sampling port defined through said liner in the interval of said spacer, by which sample fluid collected in said interstitial volume may pass through said liner; and a sampling tube in fluid communication with said port, through which said sample fluid may be transported for analysis.

13. A system according to claim 12 further comprising means for pumping said sample fluid through said sampling tube, said pumping means comprising:

a standing tube, in fluid communication with said sampling tube, and in which sampling fluid may rise;

means for applying pressure to sampling fluid within said standing tube, thereby to move sampling water through said sampling tube; and a check valve in connection with said standing tube to prevent backflow of sample fluid from said standing tube toward said interstitial volume.

14. A method for performing ground water sampling at least one sampling location in a borehole into a formation in the earth's subsurface, comprising the steps of:

extending a flexible tubular liner within the borehole;

inflating the liner to urge the liner against a wall of the borehole and to define an interior volume within the inflated liner;

attaching at least one spacer to the liner, said spacer maintaining the liner in a spaced-apart relation from the borehole wall to provide, when the liner is extended and inflated within the borehole, an interstitial volume between the liner and the borehole wall at the at least one sampling location;

covering the liner with a flexible diffusion barrier, on the tubular liner; and substantially preventing with the diffusion barrier contamination migration via diffusion through the liner to or from the interior volume.

15. The method of claim 14 wherein the step of covering the liner comprises disposing the diffusion barrier on an exterior surface of the tubular liner.

16. The method of claim 14 wherein the step of covering the liner comprises disposing the diffusion barrier on an interior surface of the tubular liner.

17. The method of claim 15 wherein the step of covering the liner comprises covering with the diffusion barrier substantially the entire exterior surface of the liner.

18. The method of claim 15 wherein the step of covering the liner comprises covering with the diffusion barrier interval portions only of the liner adjacent to each of the at least one spacers.

19. The method of claim 18 comprising the further step of securing the diffusion barrier directly to each of the at least one spacers.

20. The method of claim 16 wherein the step of covering the liner comprises covering with the diffusion barrier substantially the entire interior surface of the liner.

21. The method of claim 16 wherein the step of covering the liner comprises covering with the diffusion barrier interval portions only of the liner adjacent to each of the at least one spacer.

22. The method of claim 21 comprising the further step of securing the diffusion barrier directly to each of the at least one spacers.

23. The method of claim 14 wherein the step of covering the liner with a flexible diffusion barrier comprises selecting a diffusion barrier layer of material from the group consisting of Mylar material, Teflon material, and polyvinylidene fluoride polymer material.

24. The method of claim 14 wherein the step of covering the liner with a flexible diffusion barrier comprises selecting a diffusion barrier layer of material from the group consisting of polymer composites.

25. The method of claim 23 further comprising the step of depositing a thin metal film on the layer of barrier material.

26. The method of claim 24 further comprising the step of depositing a thin metal film on the layer of barrier material.

27. The method of claim 14 further comprising the steps of:

defining a sampling port through the liner in the interval of the spacer allowing sample fluid to collect in the interstitial volume;

passing sample fluid through the liner via the sampling port and to a sampling tube; and transporting sample fluid through the sampling tube for analysis.

28. The method of claim 27 further comprising the step of pumping the sample fluid through the sampling tube, the pumping step comprising:

allowing sample fluid to rise in a standing tube in fluid communication with the sampling tube;

applying pressure to sample fluid within the standing tube to move sampling water through the sampling tube; and preventing backflow of sample fluid from the standing tube toward the interstitial volume.

29. The method of claim 28 further comprising the steps of:

providing a sampling tube comprising polyvinylidene fluoride polymer material; and providing a standing tube comprising polyvinylidene fluoride polymer material;

thereby substantially preventing cross-contamination to or from the sample fluid.

30. The method of claim 28 comprising the step of preventing with the diffusion barrier contaminant migration from the liner interior volume into the sample fluid.

31. The method of claim 14 further comprising the step of preventing, with the diffusion barrier, migration of contaminants from within the liner into the interstitial volume.

32. The method of claim 14 further comprising the step of selecting for the barrier material a layer of flexible material manifesting a lubricating property, thereby promoting extension and inflation of the liner.

33. A system for performing sampling at a sampling location in a borehole into a formation beneath the earth's surface, comprising:

a flexible liner extendible within said borehole and inflatable with a fluid to urge said liner against a wall of said borehole, wherein when inflated said liner defines an interior volume containing said fluid;

a spacer disposed on said liner, wherein when said liner is extended and inflated within said borehole, said spacer provides an interstitial volume between said liner and said borehole wall at said sampling location;

a sampling port defined through said liner in the interval of said spacer, by which sample fluid collected in said interstitial volume may pass through said liner;

a sampling tube in fluid communication with said port, through which said sample fluid may be transported for analysis outside said liner; and a flexible diffusion barrier, comprising a layer of material directly upon said tubular liner, said barrier substantially preventing contamination migration via diffusion through the liner to or from said interior volume.

34. The system of claim 33 wherein said spacer comprises absorbent material for collection of sample fluid from the formation.

* * * * *